US006286922B1

(12) United States Patent
Kondou

(10) Patent No.: US 6,286,922 B1
(45) **Date of Patent: *Sep. 11, 2001**

(54) INKJET HEAD CONTROL SYSTEM AND METHOD

(75) Inventor: Masaaki Kondou, Niigata (JP)

(73) Assignee: NEC Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/134,870

(22) Filed: Aug. 17, 1998

(30) Foreign Application Priority Data

Aug. 18, 1997 (JP) ..... 9-221660

(51) Int. Cl.[7] ..... B41J 29/38
(52) U.S. Cl. ..... 347/10; 310/316.01
(58) Field of Search ..... 347/9, 10, 11, 347/12, 13, 14, 15; 310/317, 316, 316.01

(56) References Cited

U.S. PATENT DOCUMENTS 5,212,497 * 5/1993 Stanley et al. ..... 347/10
5,631,675 * 5/1997 Futagawa ..... 347/10
5,757,392 * 5/1998 Zhang ..... 347/14

FOREIGN PATENT DOCUMENTS 5-116350 5/1993 (JP) .
6-182993 7/1994 (JP) .
6-182997 7/1994 (JP) .
7-148920 6/1995 (JP) .
8-112894 5/1996 (JP) .
9-201963 8/1997 (JP) .

OTHER PUBLICATIONS

Patent Abstracts of Japan vol. 17, No. 24. Apr. 9, 1992 JP 4–249721.*
Derwent Publications Ltd., XP002117621 (English language abstract of JP 08 112894A, published May 7, 1996).
Patent Abstracts of Japan, vol. 199, No. 712, Dec. 25, 1997 (English language abstract of JP 09 201963, published Aug. 5, 1997).
Patent Abstracts of Japan, vol. 199, No. 711, Nov. 28, 1997 (English language abstract of JP 09 187949, published Jul. 22, 1997).
Patent Abstracts of Japan, vol. 18, No. 526, Oct. 5, 1994 (English language abstract of JP 06 182993, published Jul. 5, 1994).

* cited by examiner

*Primary Examiner*—Benjamin R. Fuller
*Assistant Examiner*—C. Dickens
(74) *Attorney, Agent, or Firm*—Foley & Lardner

(57) ABSTRACT

A control system for controlling a driving pulse applied to a piezoelectric element of an inkjet head is disclosed. A variable-voltage source produces a control voltage depending on a control signal and a pulse generator generates the driving pulse having a voltage waveform with a slope determined depending on the control voltage. A peak voltage of the driving pulse is monitored and the control signal is adjusted so that the peak voltage reaches a predetermined voltage.

24 Claims, 7 Drawing Sheets

INKJET HEAD CONTROL SYSTEM AND METHOD

BACKGROUND OF THE INVENTION

1. Field of the Invention

The present invention relates to an inkjet recording apparatus which is capable of ejecting ink droplets by making use of a piezoelectric element, and more particularly to a control system and method which controls a driving pulse applied to the piezoelectric element.

2. Description of the Related Art

There has recently been a growing interest in non-impact recording methods, because noise while recording is extremely small to such a degree that it can be neglected. Particularly, inkjet recording methods are extremely effective in that they are structurally simple and in that they can perform high-speed recording directly onto ordinary medium. There has been proposed an inkjet recording method making use of a piezoelectric element.

In the inkjet recording method making use of a piezoelectric element, a driving pulse is applied to a selected piezoelectric element and thereby the piezoelectric element is deformed to eject an ink droplet. The waveform of the driving pulse is very important to stabilize the ink ejection and improve the quality of printing because the stable and proper waveform of the driving pulse produces the stable amount of ejected ink droplet and the optimal ejection velocity. However, a variation in waveform of the the driving pulse is cause by variations in capacitance of the piezoelectric element and characteristics of each circuit element, resulting in variations in amount and ejection velocity of ink droplet.

To stabilize the ink droplet ejection to improve the quality of printing, there has been proposed an inkjet head driver in Japanese Patent Unexamined Publication No. 6-182993. The inkjet head driver sets a driving pulse to a desired voltage by adjusting the time constant and the rising time of the driving pulse.

However, the rising time is adjusted by changing the variable resistor or replacing a resistor with another resistor. Therefore, it is necessary to do the resistor adjustment prior to shipments and such adjustment is a time-consuming step. Further, after shipments, it is very difficult to adjust the rising time to cancel out a variation in pulse waveform due to a change of ambient temperature, resulting in reduced stability of the quality of printing.

Another inkjet head driver has been proposed in Japanese Patent Unexamined Publication No. 8-112894. The inkjet head driver measures the slope of leading or trailing edge of a trapezoidal driving pulse and controls the output current of a variable current source depending on an error obtained by comparing the measured slope with a preset slope.

However, the conventional inkjet head driver needs the steps of slope measurement which is not simple, resulting in increased burden upon a control processor.

SUMMARY OF THE INVENTION

It is an objective of the present invention to provide control system and method for use in an inkjet recording apparatus which can achieve the reliable and stable ink droplet ejection with simplified control.

According to the present invention, a control system for controlling a driving pulse applied to a piezoelectric element of an inkjet head is comprised of a variable-voltage source for producing a control voltage depending on a control signal; a pulse generator for generating a driving pulse having a voltage waveform with a slope determine depending on the control voltage; a monitor for monitoring a peak voltage of the driving pulse; and a controller for adjusting the control signal so that the peak voltage reaches a predetermined voltage.

As described above, the control signal is adjusted so that the peak voltage reaches the predetermined voltage and the waveform of the driving pulse is automatically set to a desired trapezoidal waveform with a slope determined depending on the control voltage. Therefore, the piezoelectric element properly deforms with stability even in the case of a change in temperature, resulting in the stable quality of printing.

Further, only the control voltage causes the slope and the height of the voltage waveform to be determined. Therefore, the waveform control is simplified with improved stability.

The pulse generator may be comprised of a constant-current source for producing first and second constant currents determined by the first and second control voltages, respectively; a waveform forming circuit for producing a voltage pulse having the voltage waveform by charging a capacitor with the first constant current for a first predetermined time period and then discharging the capacitor with the second constant current for a second predetermined time period; and an amplifier for amplifying the voltage pulse to produce the driving pulse.

The waveform forming circuit may be comprised of a timing generator for generating a first timing pulse having a pulse width of the first predetermined time period and a second timing pulse having a pulse width of the second predetermined time period wherein there is a predetermined time interval between a trailing edge of the first timing pulse and a leading edge of the second timing pulse; and a waveform controller for producing the voltage pulse having a trapezoidal waveform where a leading-edge slope and a height of the trapezoidal waveform is determined by the first constant current, a trailing-edge slope is determined by the second constant current.

BRIEF DESCRIPTION OF THE DRAWINGS

The above and other objects and advantages will become apparent from the following detailed description when read in conjunction with the accompanying drawing wherein.

DETAILED DESCRIPTION OF THE PREFERRED EMBODIMENT

Figure 1:
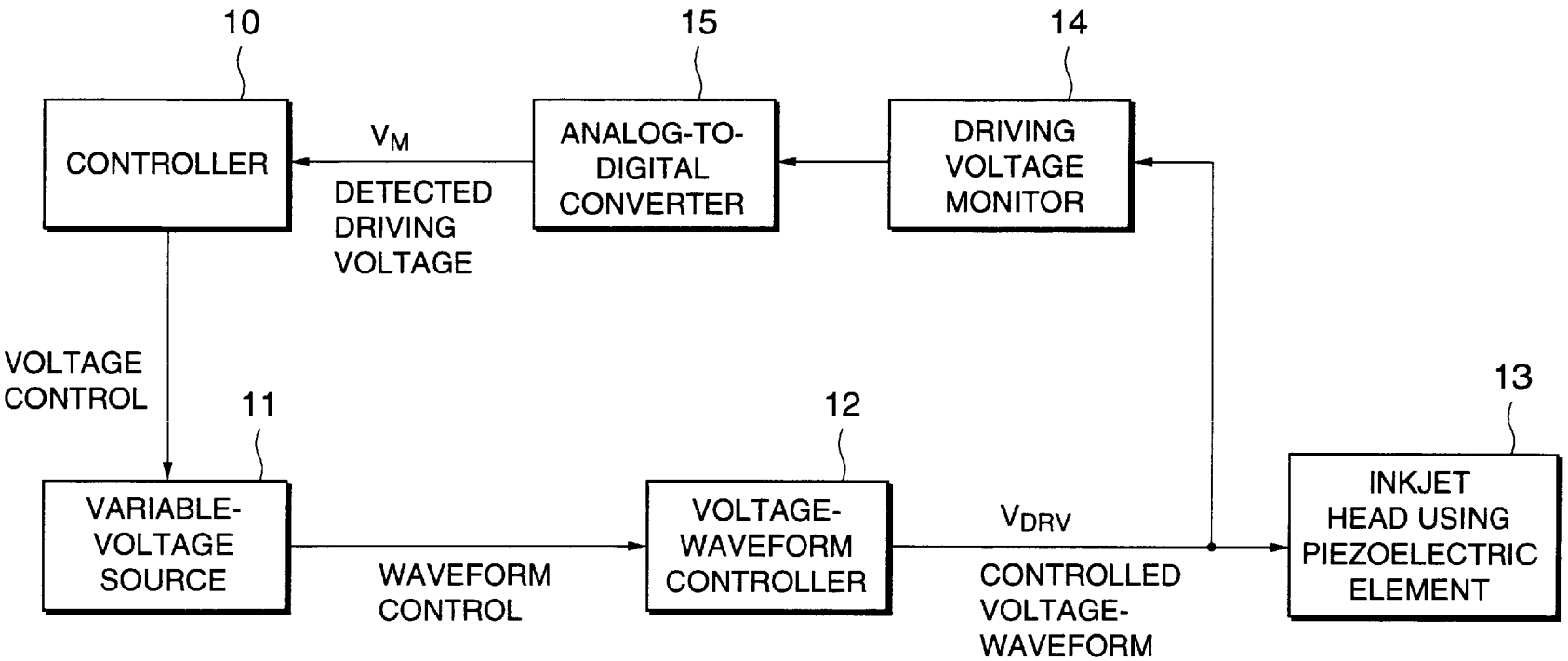
FIG. 1 is a schematic block diagram showing the circuit configuration of an inkjet recording apparatus according to an embodiment according to the present invention.

Referring to FIG. 1, an inkjet recording apparatus has a control loop for controlling the waveform of a driving pulse by adjusting the peak voltage of the driving pulse while detecting the peak voltage applied to a piezoelectric element. More specifically, a controller 10 produces a voltage control signal depending on a detected driving voltage $V_M$. The voltage control signal makes a variable-voltage source 11 produce a waveform control voltage which is output to a voltage-waveform controller 12. The voltage-waveform controller 12 produces a driving pulse whose waveform is controlled depending on the waveform control voltage and outputs it to an inkjet head 13 making use of a piezoelectric element.

The voltage $V_{DRV}$ of the driving pulse is monitored by a driving voltage monitor 14 and the monitored voltage is sampled and converted into digital form by an analog-to-digital converter (ADC) 15 to produce the detected driving voltage $V_M$. The controller 10 compares the detected driving voltage $V_M$ to preset voltage and produces the voltage control signal so that the detected driving voltage $V_M$ agrees with the preset voltage. The voltage control signal may be produced so that a difference of the detected driving voltage $V_M$ and the preset voltage is reduced in units of a predetermined step. The more detailed descriptions will be made hereinafter.

Figure 2:
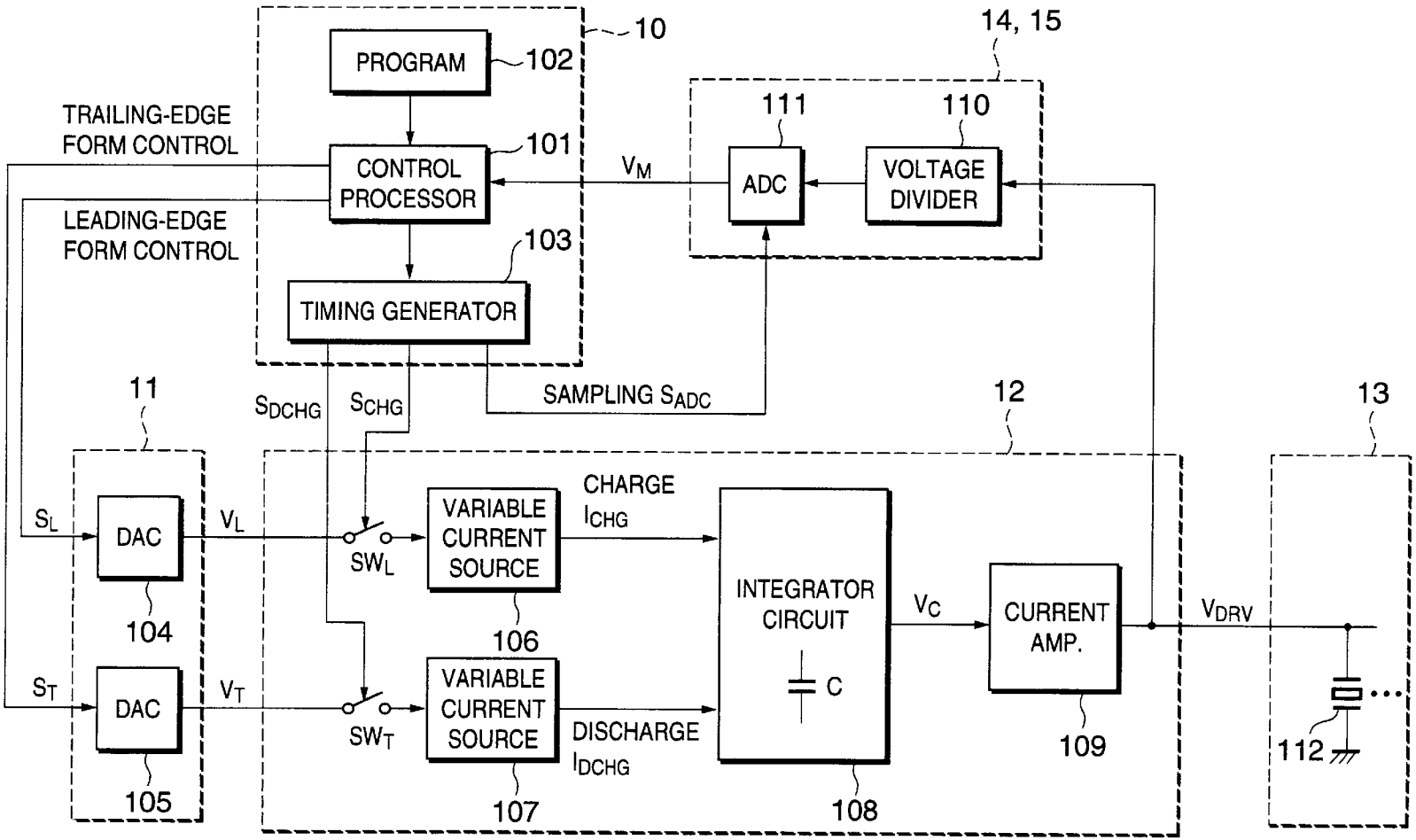
FIG. 2 is a block diagram showing the more detailed circuit configuration of the embodiment as shown in FIG. 1.

Referring to FIG. 2, the controller 10 is comprised of a control processor 101, a read-only memory (ROM) 102 storing a program, and a timing generator 103. The control processor 101 is a program-controlled processor on which the program runs. Under control of the control processor 101 running the program, the timing generator 103 generates a charge timing signal $S_{CSC}$, a discharge timing signal $S_{DCHG}$ and a sampling timing signal $S_{DSC}$ which have predetermined pulse widths, respectively.

The control processor 101 produces a leading-edge form control signal $S_L$ and a trailing-edge form control signal $S_T$ depending on a difference of the detected driving voltage $V_M$ and a preset voltage. The leading-edge form control signal $S_L$ and the trailing-edge form control signal $S_T$ are a voltage-setting signal which is used to determine the peak voltage and the slopes of the leading edge and the trailing edge of the driving pulse as will be described hereinafter.

The variable-voltage source 11 may be formed with a digital-to-analog converter (DAC). In this embodiment, the variable-voltage source 11 is comprised of DA converters 104 and 105 which receive the leading-edge form control signal $S_L$ and the trailing-edge form control signal $S_T$ from the control processor 101, respectively. The DA converters 104 and 105 convert the control signals $S_L$ and $S_T$ to analog voltages $V_L$ and $V_T$, respectively, which are output to the voltage-waveform controller 12.

The voltage-waveform controller 12 is comprised of open/close switches $SW_L$ and $SW_T$, variable current sources 106 and 107, and integrator circuit 108, and a current amplifier 109. The open/close switches $SW_L$ and $SW_T$ perform open/close operations according to the charge timing signal $S_{CHG}$ and the discharge timing signal $S_{DCHG}$, respectively. The variable current sources 106 and 107 receive the analog voltages $V_L$ and $V_T$ from the DA converters 104 and 105 through the open/close switches $SW_L$ and $SW_T$ and produce a charge constant current $I_{CHG}$ and a discharge constant current $I_{DCHG}$ depending on the analog voltages $V_L$ and $V_T$, respectively.

The integrator circuit 108 includes a capacitor C which is charged or discharged with the charge constant current $I_{CHG}$ or the discharge constant current $I_{DCHG}$. The voltage $V_C$ across the capacitor C is output to the current amplifier 109 which produces the driving pulse having a desired trapezoidal waveform. Since $I=C\times dV_C/dt$, the rate of increase of the voltage $V_C$ is determined by the charge constant current $I_{CHG}$ and the rate of decrease of the voltage $V_C$ is determined by the discharge constant current $I_{DCHG}$. In other words, the leading-edge form of the driving pulse is determined by the analog voltages $V_L$ and the trailing-edge form of the driving pulse is determined by the analog voltages $V_T$.

The voltage $V_{DRV}$ of the driving pulse is divided by a voltage divider 110 because the voltage $V_{DRV}$ of the driving pulse is much higher than a voltage used in logic circuits. The resultant divided voltage is converted into digital form by an AD converter 111. The voltage divider 110 is comprised of a plurality of resistors connected in series.

The AD converter 111 samples a voltage from the divided voltage with the timing of the sampling timing signal $S_{ADC}$ and then converts it into digital form to produce the detected voltage $V_M$. As will be described later, the sampling timing signal $S_{ADC}$ is generated when the voltage $V_{DRV}$ of the driving pulse is at the peak voltage of the trapezoidal waveform, in other words, at a time instant of the time period corresponding to the upper or shorter base of the trapezoidal waveform. The detected voltage $V_M$ is output to the control processor 101 where the detected voltage $V_M$ is compared to data of the preset voltage expected to be applied to a piezoelectric element.

The voltage $V_{DRV}$ of the driving pulse is also output to the inkjet head 13 and is applied to a selected piezoelectric element 112. Since the driving pulse is automatically set to the desired trapezoidal waveform having the expected peak voltage and slopes by the control loop adjusting the analog voltage $V_L$ and $V_T$, the piezoelectric element 112 properly deforms with stability even in the case of a change in temperature, resulting in the stable quality of printing.

WAVEFORM CONTROL OPERATION

Figure 3:
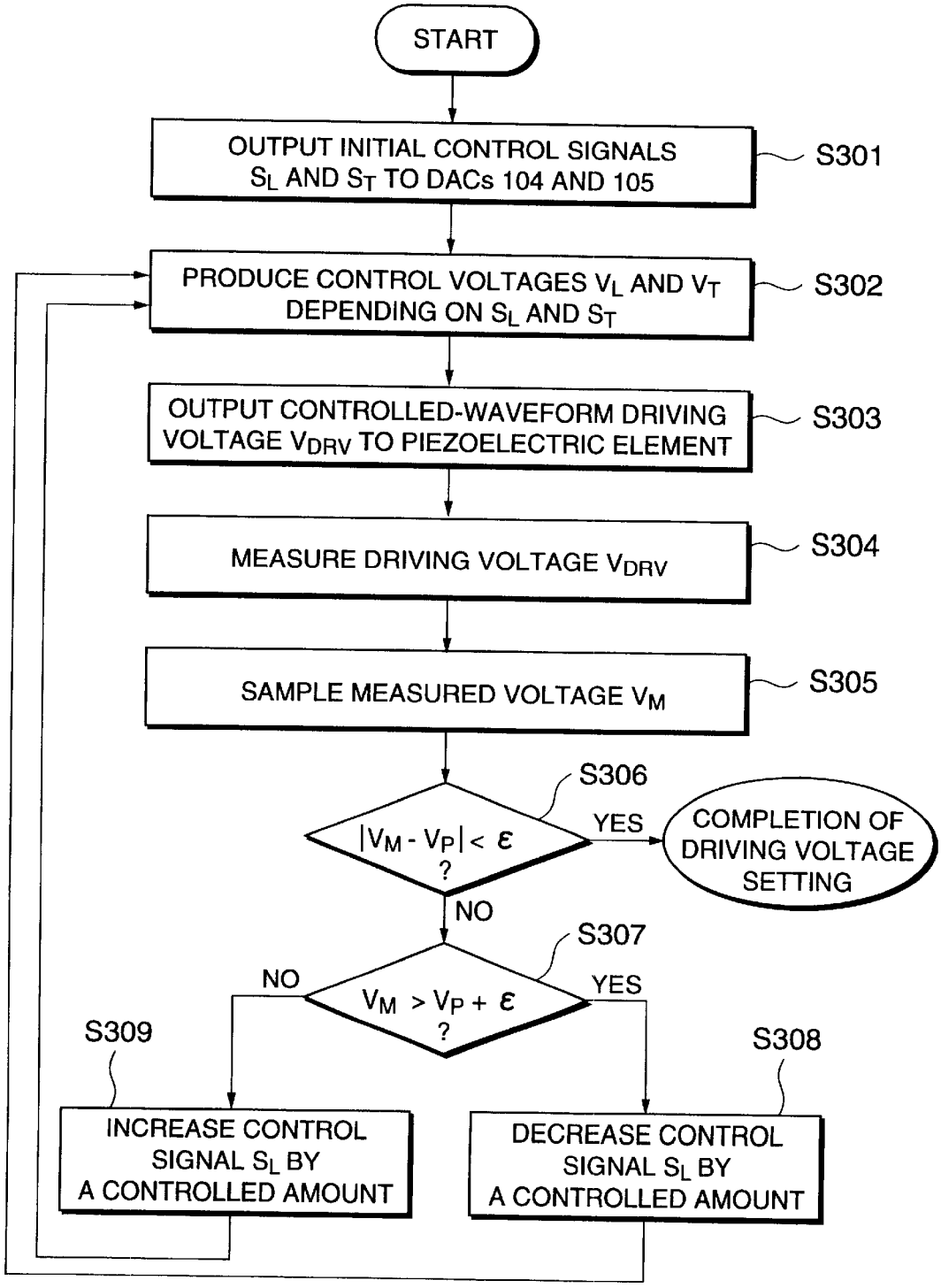
FIG. 3 is a flow chart showing a control operation in the embodiment.

Referring to FIG. 3, when starting the program, the control processor 101 outputs initial control signals $S_{LO}$ and $S_{TO}$ to the DA converters 104 and 105, respectively (step S301). The initial control signals $S_{LO}$ and $S_{TO}$ are previously stored in the ROM 102 and are expected to provide a desired peak voltage of the driving pulse. The respective initial control signals $S_{LO}$ and $S_{TO}$ are converted to initial analog voltages $V_{LO}$ and $V_{TO}$. In general, the analog voltages $V_L$ and $V_T$ are produced depending on the leading-edge and trailing-edge form control signals $S_L$ and $S_T$, respectively (step S302).

The timing generator 103 outputs the charge timing signal $S_{CHG}$ to the switch $SW_L$. The charge timing signal $S_{CHG}$ causes the switch $SW_L$ to be closed and the variable current source 106 outputs the charge constant current $I_{CHG}$ to the integrator circuit 108. As the capacitor C is charged with the charge constant current $I_{CHG}$, the voltages $V_C$ linearly increases and, when the charge timing signal $S_{CHG}$ falls and the switch $SW_L$ is open, the voltages $V_C$ at that time is kept as a peak value. Therefore, the time-varying voltage $V_{DRV}$ having such an upward slope and the peak value is applied to the piezoelectric elements 112 (step S303). The voltage divider 110 divides the voltage $V_{DRV}$ to produce a divided voltage (step S304).

After a lapse of predetermined time interval, the control processor 101 instructs the timing generator 103 to output the sampling timing signal $S_{ADC}$ to the AD converter 111. This causes the AD converter 111 to sample a voltage from the divided voltage with the timing of the sampling timing signal $S_{ADC}$ and then converts it into digital form to produce the detected voltage $V_M$ (step S305). Thereafter, the timing generator 103 outputs the discharge timing signal $S_{DCHG}$ to the switch $SW_T$. The discharge timing signal $S_{DCHG}$ causes the switch $SW_T$ to be closed and the variable current source 107 provides the discharge constant current $T_{DCHG}$ to the integrator circuit 108. As the capacitor C is discharged with the discharge constant current $I_{DCHG}$, the voltages $V_C$ linearly decreases and, when or before the discharge timing signal $S_{DCHG}$ falls and the switch $SW_T$ is open, the voltages $V_C$ falls to the grounding level.

When receiving the detected voltage $V_M$ from the AD converter 111, the control processor 101 determines whether the detected voltage $V_M$ falls into a predetermined range around an expected voltage $V_P$ (step S306). Here, the control processor 101 calculates an absolute difference between the detected voltage $V_M$ and the expected voltage $V_P$ and then compares the absolute difference to a permissible error $\epsilon$. If the detected voltage $V_M$ falls into the predetermined range around the expected voltage $V_P$ (YES in step S306), the driving voltage setting control is terminated.

Contrarily, if the detected voltage $V_M$ falls out of the predetermined range around the expected voltage $V_P$ (NO in step S306), the control processor 101 determines whether the detected voltage $V_M$ is higher than the expected voltage $V_P$ (step S307). When the detected voltage $V_M$ is higher than the expected voltage $V_P$ (YES in step S307), the control processor 101 decreases the leading-edge form control signal $S_L$ by a controlled amount (step S308). When the detected voltage $V_M$ is not higher than the expected voltage $V_P$ (NO in step S307), the control processor 101 increases the leading-edge form control signal $S_L$ by a controlled amount (step S309). The controlled amount may be a fixed step or a variable step which increases depending on the absolute difference calculated in the step S306.

When the leading-edge form control signal $S_L$ has been updated, control goes back to the step S302 where the analog voltages $V_L$ and $V_T$ are produced depending on the leading-edge and trailing-edge form control signals $S_L$ and $S_T$, respectively. In general, the trailing-edge form control signal $S_T$ varies in accordance with the leading-edge form control signal $S_L$.

In this manner, the steps S302–S309 are repeatedly performed and the detected voltage $V_M$ changes from the initial voltage to the expected voltage $V_P$ while the driving pulse changing in upward and downward slopes thereof. Therefore, the waveform of the driving pulse applied to the piezoelectric element 112 is automatically adjusted.

It is possible to replace the steps S3076–S309 with a table searching step in FIG. 3. More specifically, the controller 10 is provided with a table storing the leading-edge form control signal $S_L$ and the trailing-edge form control signal $S_T$ with respect to the difference of a detected voltage $V_M$ and the expected voltage $V_P$. When receiving the detected voltage $V_M$, the control processor 101 calculates the difference of the detected voltage $V_M$ and the expected voltage $V_P$ and searches the table for the difference to produce the corresponding control signal $S_L$ and $S_T$.

VOLTAGE-WAVEFORM CONTROLLER

Figure 4:
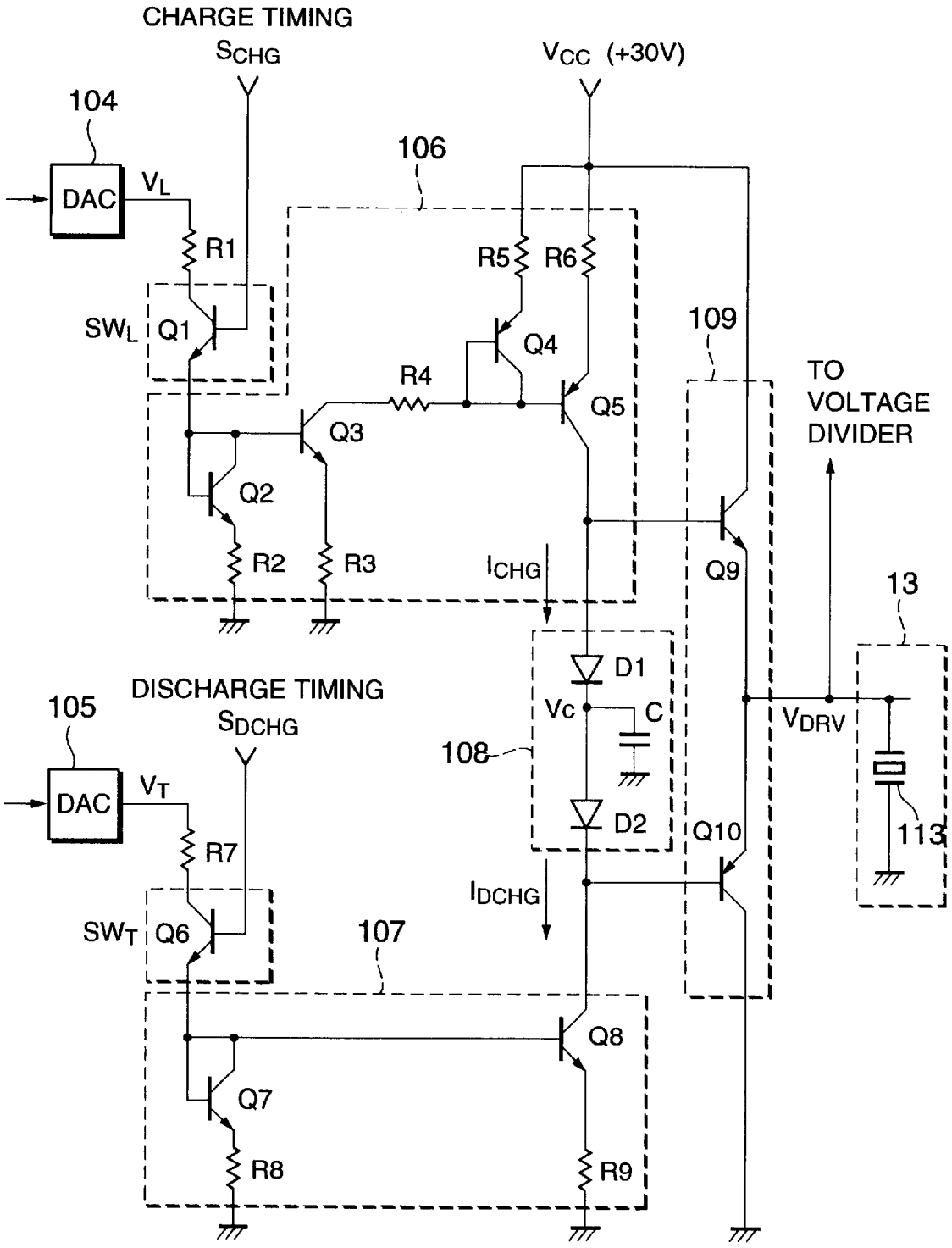
FIG. 4 is a detailed circuit diagram showing a waveform generating circuit in the embodiment.

FIG. 4 shows the detailed circuit configuration of an example of the voltage-waveform controller 12. The switch $SW_L$ is comprised of a transistor Q1 having a collector connected to the DA converter 104 through a resistor R1. The base of the transistor Q1 receives the charge timing signal $S_{CHG}$ from the timing generator 103. The emitter of the transistor Q1 is connected to the variable current source 106.

The variable current source 106 includes two stages of current mirror circuit. The first current mirror circuit is comprised of transistors Q2 and Q3. The base and collector of the transistor Q2 and the base of the transistor Q3 are connected in common to the emitter of the transistor Q1. The respective emitters of the transistors Q2 and Q3 are grounded through resistors R2 and R3. The collector of the transistor Q3 is connected to the second current mirror circuit through a resistor R4. The second current mirror circuit is comprised of transistors Q4 and Q5. The base and collector of the transistor Q4 and the base of the transistor Q4 are connected in common to the collector of the transistor Q3 through the resistor R4. The respective emitters of the transistors Q4 and Q5 are connected to power supply voltage $V_{CC}$ through resistors R5 and R6. The collector of the transistor Q5 is connected to the integrator circuit 108 and the current amplifier 109. The two states of current mirror circuit is needed to match the logic voltage level of the DA converter 104 (here, +5V) with the power supply voltage $V_{CC}$ (here, +30V).

The integrator circuit 108 is comprised of the capacitor C and diodes D1 and D2. The capacitor C is connected to the collector of the transistor Q5 through the diode D1 and to the variable current source 107 through the diode D2.

When the transistor Q1 is forced into conduction by the charge timing signal $S_{CHG}$, the analog voltages $V_L$ of the DA converter 104 causes a constant current to flow through the resistors R1 and R2. This constant current activates the first and second current mirror circuits and the charge constant current $I_{CHG}$ flows into the capacitor C through the diode D1 of the integrator circuit 108. As described before, the capacitor C is charged with the charge constant current $I_{CHG}$ and the voltage $V_C$ across the capacitor C increases linearly.

On the other hand, the switch $SW_T$ is comprised of a transistor Q6 having a collector connected to the DA converter 105 through a resistor R7. The base of the transistor Q6 receives the discharge timing signal $S_{DCHG}$ from the timing generator 103. The emitter of the transistor Q6 is connected to the variable current source 107.

The variable current source 107 includes a current mirror circuit. The current mirror circuit is comprised of transistors Q7 and Q8. The base and collector of the transistor Q7 and the base of the transistor Q8 are connected in common to the emitter of the transistor Q6. The respective emitters of the transistors Q7 and Q8 are grounded through resistors R8 and R9. The collector of the transistor Q8 is connected to the capacitor C through the diode D2 of the integrator circuit 108.

When the transistor Q6 is forced into conduction by the charge timing signal $S_{DCHG}$, the analog voltages $V_T$ of the DA converter 105 causes a constant current to flow though the resistors R7 and R8. This constant current activates the current mirror circuit and the discharge constant current $T_{DCHG}$ flows from the capacitor C through the diode D2 of the integrator circuit 108. As described before, the capacitor C is discharged with the discharge constant current $I_{DCHG}$ and the voltage $V_C$ across the capacitor C decreases linearly.

The current amplifier 109 is comprised of transistors Q9 and Q10. The collector of the transistor Q9 is connected to the power supply voltage $V_{CC}$ and the emitter of the transistor Q9 is connected to that of the transistor Q10. The base of the transistor Q9 is connected to the collector of the transistor Q5 and that of the transistor Q10 is connected to the collector of the transistor Q8. The emitters of the transistors Q9 and Q10 are connected to the inkjet head 13 and the voltage divider 110. The current amplifier 109 provides an output current required to activate the piezoelectric element 112. Therefore, it is possible to use the integrator circuit 108 and the current mirror circuits with the lower rating thereof.

WAVEFORM ADJUSTMENT

Figures 5A, 5B:
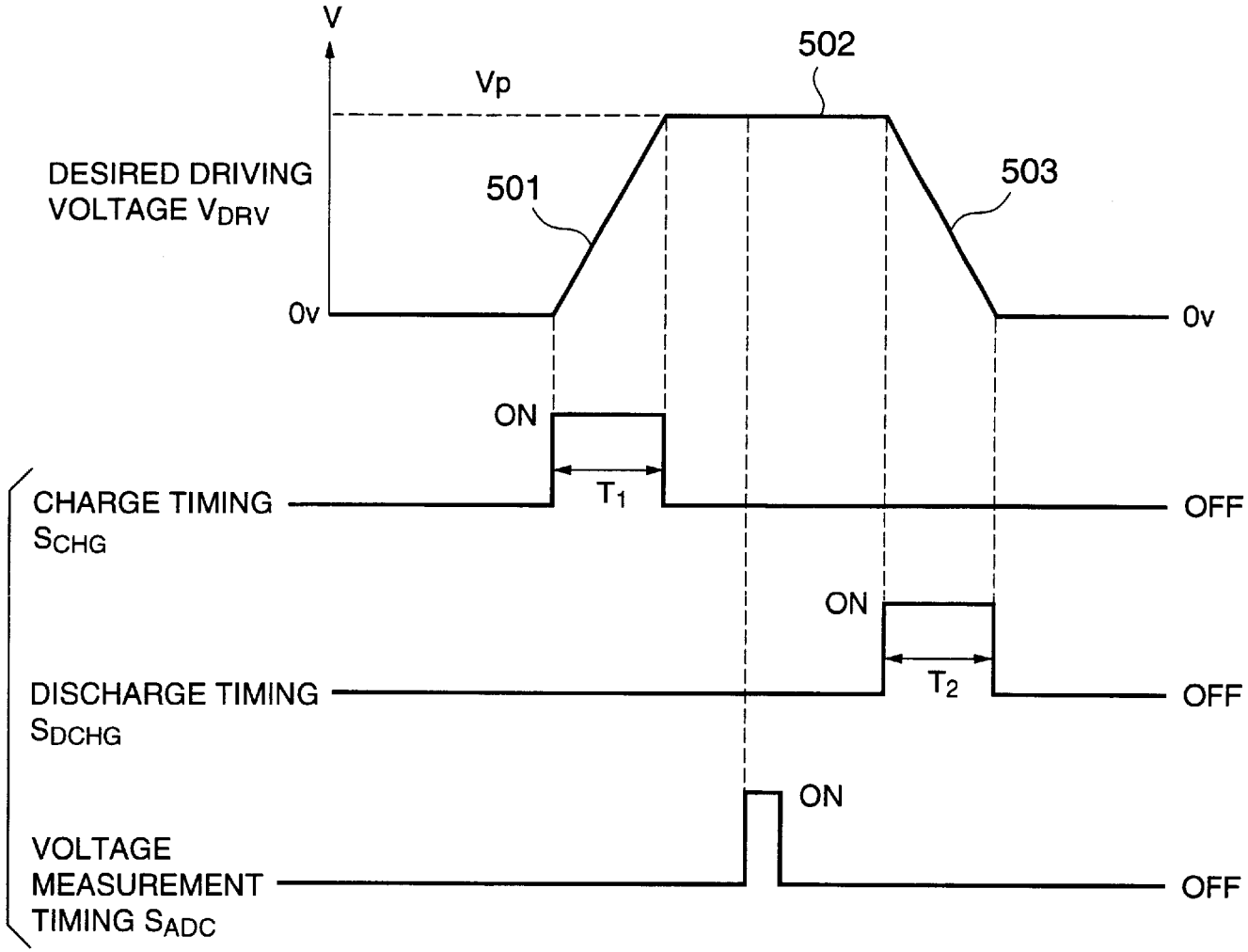
FIG. 5A is a waveform diagram showing an example of a driving pulse to be applied to a piezoelectric element of the inkjet recording apparatus according to the embodiment.
FIG. 5B is a waveform diagram showing charge and discharge timing signals and voltage measurement timing signal in the case of the driving pulse as shown in FIG. 5A.

Referring to FIG. 5A, the control processor 101 running the program has a desired peak voltage $V_P$ of the driving pulse. As described before, the upward slope 501 and the downward slope 503 of the trapezoidal waveform are automatically determined by the peak voltage of the upper base thereof. Therefore, by adjusting the peak voltage, a desired waveform of the driving pulse can be obtained. The rising time of the upward slope 501 is determined by the charge timing signal $S_{CHG}$ and the falling time of the downward slope 503 is determined by the discharge timing signal $S_{DCHG}$.

Referring to FIG. 5B, more specifically, the timing generator 103 outputs the charge timing signal $S_{CHG}$ of a pulse width $T_1$ to the switch $SW_L$ and thereby the switch $SW_L$ is closed and the variable current source 106 outputs the charge constant current $I_{CHG}$ to the integrator circuit 108. As the capacitor C is charged with the charge constant current $I_{CHG}$, the voltages $V_C$ across the capacitor C linearly increases to form the upward slope 501. When the charge timing signal $S_{CHG}$ falls and the switch $SW_L$ is open, the voltages $V_C$ at that time is kept as the peak voltage to form the upper base 502. Therefore, the time-varying voltage $V_{DRV}$ having such an upward slope and the peak voltage is applied to the piezoelectric elements 112.

After a lapse of predetermined time interval, the control processor 101 instructs the timing generator 103 to output the sampling timing signal $S_{ADC}$ to the AD converter 111 and then receives the detected voltage $V_M$. After a further lapse of predetermined time interval, the timing generator 103 outputs the discharge timing signal $S_{DCHG}$ of pulse width $T_2$ to the switch $SW_T$ to be closed and the variable current source 107 provides the discharge constant current $I_{DCHG}$ to the integrator circuit 108. As the capacitor C is discharged with the discharge constant current $I_{DCHG}$, the voltages $V_C$ across the capacitor C linearly decreases to form the downward slope 503 and, when or before the discharge timing signal $S_{DCHG}$ falls and the switch $SW_T$ is open, the driving voltage $V_{DRV}$ falls to the grounding level.

Figures 6A, 6B:
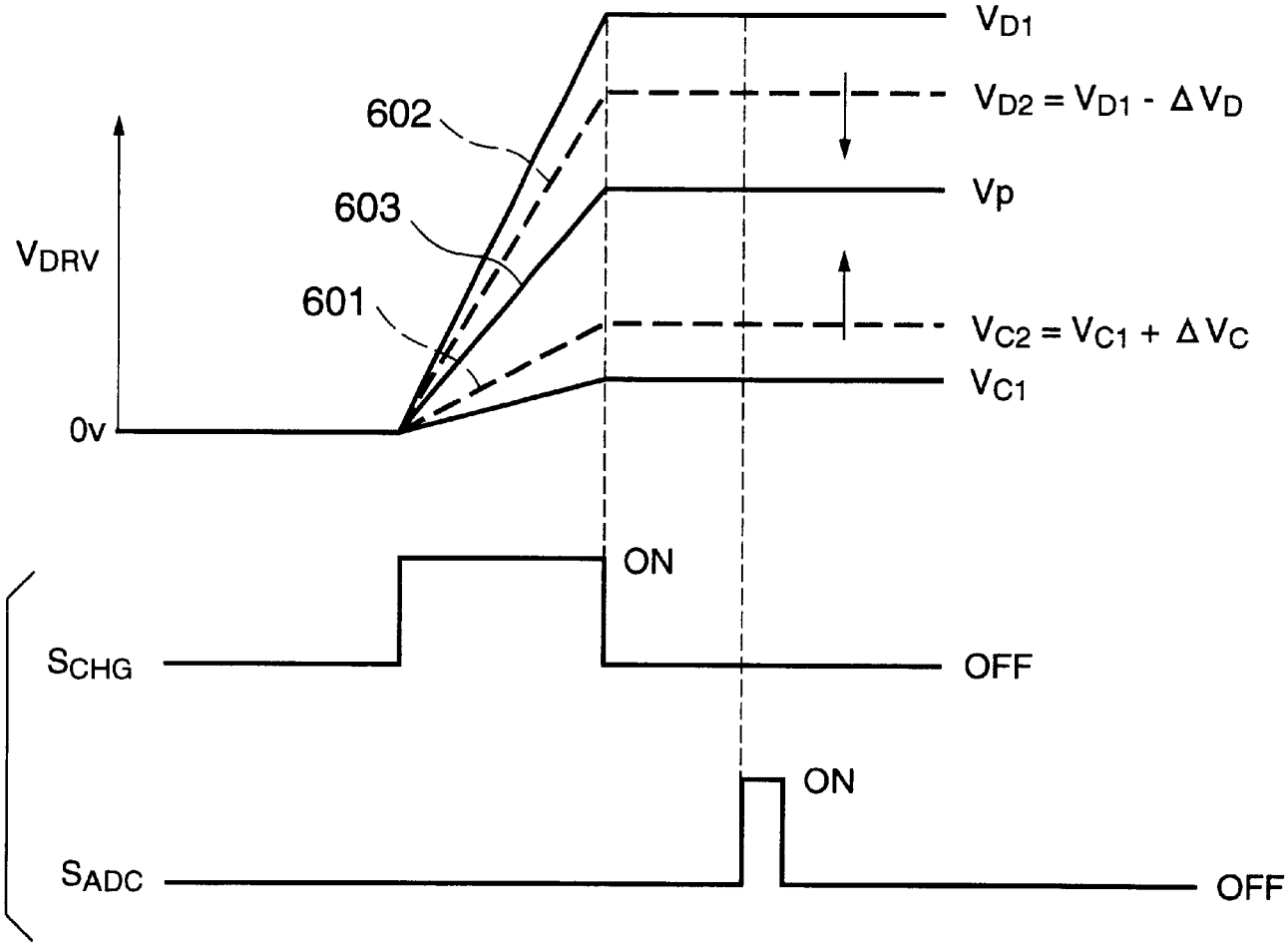
FIG. 6A is a waveform diagram showing an example of a driving pulse to be applied to a piezoelectric element for explanation of a voltage control operation of the embodiment.
FIG. 6B is a waveform diagram showing charge timing signal and voltage measurement timing signal in the case of the driving pulse as shown in FIG. 6A.

Referring to FIGS. 6A and 6B, when starting the program, the control processor 101 produces the initial control signals $S_{LO}$ and $S_{TO}$ which are expected to provide the desired trapezoidal waveform of the driving pulse. In this initial state, when receiving the detected voltage $V_M=V_{C1}$ lower than the expected peak voltage $V_P$ from the AD converter 111, the control processor 101 increases the leading-edge form control signal $S_L$ by a fixed amount which will provide a predetermined voltage increase step $\Delta V_C$. Accordingly, the driving voltage $V_{DRV}$ linearly increases with an upward slope 601 corresponding to the updated peak voltage $V_{C2}=V_{C1}+\Delta V_C$. In this manner, the control processor 101 repeatedly increases the leading-edge form control signal $S_L$ in steps of the fixed amount until the peak voltage reaches the expected peak voltage $V_P$. It is preferable that the initial control signal $S_{LO}$ is set to a lower value so that the detected voltage $V_M$ is lower than the expected peak voltage $V_P$.

Contrarily, when receiving the detected voltage $V_M=V_{DO}$ higher than the expected peak voltage $V_P$ from the AD converter 111, the control processor 101 decreases the leading-edge form control signal $S_L$ by a fixed amount which will provide a predetermined voltage decrease step $\Delta V_D$. Accordingly, the driving voltage $V_{DRV}$ linearly decreases with a downward slope 602 corresponding to the updated peak voltage $V_{D2}=V_{D1}-\Delta V_D$. In this manner, the control processor 101 repeatedly decreases the leading-edge form control signal $S_L$ in steps of the fixed amount until the peak voltage reaches the expected peak voltage $V_P$.

As described before, the increase/decrease rate may be a variable step which increases or decreased depending on the absolute difference of the detected voltage and the expected peak voltage.

According to such waveform adjustment, the waveform of a driving pulse can be properly adjusted to stabilize the ink droplet ejection even in the case of variations of circuit parameters due to a change of ambient temperature.

Figures 7A, 7B:
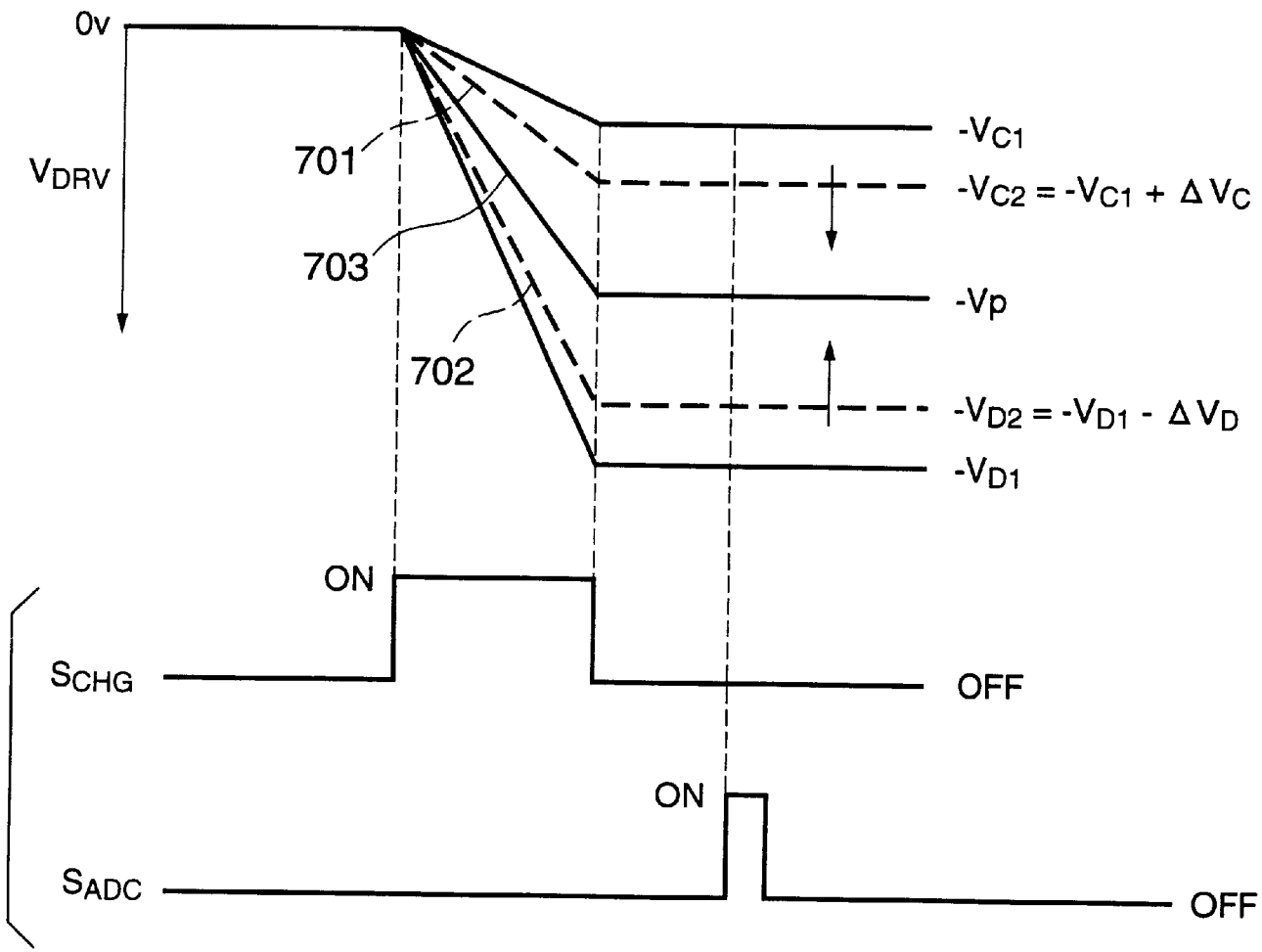
FIG. 7A is a waveform diagram showing another example of a driving pulse to be applied to a piezoelectric element for explanation of a voltage control operation of the embodiment.
FIG. 7B is a waveform diagram showing charge timing signal and voltage measurement timing signal in the case of the driving pulse as shown in FIG. 7A.

Referring to FIGS. 7A and 7B, the present invention can be also applied to the case of negative peak voltage. Since the operation is basically similar to that of the case as shown in FIGS. 6A and 6B, the detailed descriptions are omitted.

While the invention has been described with reference to the specific embodiment thereof, it will be appreciated by those skilled in the art that numerous variations, and modifications, and combinations are to be reported as being within the scope of the invention.

What is claimed is:

1. A control system for controlling a driving pulse applied to a piezoelectric element of an inkjet head, comprising:

a variable-voltage source that produces a control voltage depending on a control signal applied to the variable-voltage source;

a pulse generator that generates a driving pulse having a voltage waveform with a slope determined depending on the control voltage;

a driving voltage monitor that monitors an actual peak voltage of the driving pulse and that outputs a value proportional to the peak voltage; and a controller that receives the proportional value output by the driving voltage monitor and that adjusts the control signal so that the peak voltage reaches a predetermined voltage.

2. The control system according to claim 1, wherein the controller changes the control signal in steps of a predetermined amount until the peak voltage falls into a permissible range around the predetermined voltage.

3. The control system according to claim 2, wherein the controller initially sets the control signal to a lower value so that the peak voltage is lower than the predetermined voltage by more than a predetermined permissible error.

4. The control system according to claim 1, wherein the controller changes the control signal by a variable amount depending on a difference of the peak voltage and the predetermined voltage until the peak voltage falls into a permissible range around the predetermined voltage.

5. The control system according to claim 3, wherein the controller initially sets the control signal to a lower value so that the peak voltage is lower than the predetermined voltage by more than a predetermined permissible error.

6. The control system according to claim 1, wherein the controller calculates a difference between the peak voltage and the predetermined voltage and adjusts the control signal so that the difference is reduced.

7. The control system according to claim 1, wherein the controller comprises:

a calculator that calculates a difference between the peak voltage and the predetermined voltage;

a table that stores a plurality of control signals respectively corresponding to differences between peak voltages and the predetermined voltage; and a searcher that searches the table for a calculated difference to produce the control signal corresponding to the calculated difference.

8. The control system according to claim 1, wherein the pulse generator comprises:

a constant-current source that produces a constant current which is determined by the control voltage;

a waveform forming circuit that forms the voltage waveform with the slope formed by integration of the constant current; and an output circuit that provides the driving pulse based on the voltage waveform.

9. The control system according to claim 8, wherein a peak voltage of the voltage waveform is determined by the constant current with a predetermined integration time period.

10. The control system according to claim 1, wherein the variable-voltage source produces first and second control voltages depending on first and second signals, and the pulse generator comprises:

a first constant-current source that produces a first constant current which is determined by the first control voltage;

a second constant-current source that produces a second constant current which is determined by the second control voltage;

a waveform forming circuit that produces a voltage pulse having the voltage waveform by charging a capacitor with the first constant current and then discharging the capacitor with the second constant current; and an amplifier that amplifies the voltage pulse to produce the driving pulse, and the controller adjusts the first and second control signals so that the peak voltage reaches the predetermined voltage.

11. The control system according to claim 10, wherein a peak voltage of the voltage waveform is determined by the first constant current with a predetermined charging time.

12. A control system for controlling a driving pulse applied to a piezoelectric element of an inkjet head, comprising:

a variable-voltage source that produces a first control voltage corresponding to a first control signal applied to the variable-voltage source and a second control voltage corresponding to a second control signal applied to the variable voltage source;

a constant-current source that produces first and second constant currents determined by the first and second control voltages, respectively;

a waveform forming circuit that produces a voltage pulse having the voltage waveform by charging a capacitor with the first constant current for a first predetermined time period and then discharging the capacitor with the second constant current for a second predetermined time period;

an amplifier that amplifies the voltage pulse to produce the driving pulse;

a driving voltage monitor that monitors an actual peak voltage of the driving pulse and that outputs a value proportional to the peak voltage; and a controller that receives the proportional value output by the driving voltage monitor and that adjusts the first control signal so that the peak voltage reaches the predetermined voltage.

13. The control system according to claim 12, wherein the waveform forming circuit comprises:

a timing generator that generates a first timing pulse having a pulse width of the first predetermined time period and a second timing pulse having a pulse width of the second predetermined time period, wherein there is a predetermined time interval between a trailing edge of the first timing pulse and a leading edge of the second timing pulse; and a waveform controller that produces the voltage pulse having a trapezoidal waveform where a leading-edge slope and a height of the trapezoidal waveform is determined by the first constant current, and a trailing-edge slope is determined by the second constant current.

14. The control system according to claim 12, wherein the controller changes the first control signal in steps of a predetermined amount until the peak voltage falls into a permissible range around the predetermined voltage.

15. The control system according to claim 12, wherein the controller changes the first control signal by a variable amount varying depending on a difference of the peak voltage and the predetermined voltage until the peak voltage falls into a permissible range around the predetermined voltage.

16. The control system according to claim 12, wherein the controller calculates a difference between the peak voltage and the predetermined voltage and adjusts the first control signal so that the difference is reduced.

17. The control system according to claim 12, wherein the controller comprises:

a calculator that calculates a difference between the peak voltage and the predetermined voltage;

a table that stores a plurality of first control signals respectively corresponding to differences between peak voltages and the predetermined voltage; and a searcher that searches the table for a calculated difference to produce the first control signal corresponding to the calculated difference.

18. A control method for controlling a driving pulse applied to a piezoelectric element of an inkjet head, comprising the steps of:

a) producing a control voltage depending on a control signal;

b) generating a driving pulse having a voltage waveform with a slope determined depending on the control voltage;

c) monitoring an actual peak voltage of the driving pulse and outputting a value proportional to the peak voltage; and d) adjusting the control signal based on the peak voltage so that the peak voltage reaches a predetermined value.

19. The control method according to claim 18, wherein, in the step d), the control signal is changed in steps of a predetermined amount until the peak voltage falls into a permissible range around the predetermined voltage.

20. The control method according to claim 19, wherein the control signal is initially set to a lower value so that the peak voltage is lower than the predetermined voltage by more than a predetermined permissible error.

21. The control method according to claim 18, wherein, in step d), the control signal is changed by a variable amount varying depending on a difference of the peak voltage and the predetermined voltage until the peak voltage falls into a permissible range around the predetermined voltage.

22. The control method according to claim 21, wherein the control signal is initially set to a lower value so that the peak voltage is lower that the predetermined voltage by more than a predetermined permissible error.

23. The control method according to claim 18, wherein the step d) comprises the steps of:

calculating a difference between the peak voltage and the predetermined voltage; and adjusting the control signal so that the difference is reduced.

24. The control method according to claim 18, wherein the step d) comprises the steps of:

calculating a difference between the peak voltage and the predetermined voltage;

storing a plurality of control signals respectively corresponding to differences between peak voltages and the predetermined voltage; and searching the table for a calculated difference to produce the control signal corresponding to the calculated difference.

* * * * *